United States Patent [19]

Shakespeare

[11] 4,061,287

[45] Dec. 6, 1977

[54] PAPER-WINDING UNITS

[76] Inventor: Keith James Shakespeare, Slough Place Farm, Cuckfield, Sussex, England

[21] Appl. No.: 720,449

[22] Filed: Sept. 3, 1976

[30] Foreign Application Priority Data

Sept. 3, 1975 United Kingdom ..... 36198/75

[51] Int. Cl.[2] ..... B65H 17/02; B65H 59/00

[52] U.S. Cl. ..... 242/67.1 R; 242/75.5

[58] Field of Search ..... 242/75.3, 75, 75.5, 242/67.1 R, 68.3, 68.4

[56] References Cited

U.S. PATENT DOCUMENTS

| | | | |
|---|---|---|---|
| 1,693,876 | 12/1928 | Unruh | 242/68.4 |
| 2,700,513 | 1/1955 | Miles | 242/75.5 |
| 3,113,742 | 12/1963 | Bevon | 242/67.1 R |
| 3,338,531 | 8/1967 | Novotny | 242/67.1 R |
| 3,782,666 | 1/1974 | Sandrone | 242/75.3 |

*Primary Examiner*—Edward J. McCarthy
*Attorney, Agent, or Firm*—Roylance, Abrams, Berdo & Kaul

[57] ABSTRACT

This invention relates to paper-winding units for use on teleprinters. Known teleprinter paper-winding units will not receive paper of varying widths, and it is an object of the invention to provide a unit which does not suffer from this disadvantage. This object is achieved by winding the paper on a driven shaft mounted in a bearing at one end only. More specifically, the invention comprises an electric motor fixed to a mounting plate and driving a shaft carrying a cardboard roll for the paper which passes over a fixed guide rod, and a control rod mounted on a spring-loaded lever. The lever controls a switch for the electric motor so that the motor is switched on and off automatically in accordance with the tension in the paper.

6 Claims, 2 Drawing Figures

PAPER-WINDING UNITS

This invention relates to paper-winding units and is particularly concerned with the provision of a paper-winding unit suitable for use in connection with teleprinters.

The paper used in teleprinters normally consists of two or more continuous lengths of paper separated by carbon paper and there is frequently a requirement that one length of paper shall be wound into a roll after messages have been printed on it. It is known to provide paper-winding units for this purpose, but existing units are not suitable for attachment to all types of teleprinter and in particular will not receive paper of varying widths.

Accordingly, it is an object of the present invention to provide a paper-winding unit which is more readily applicable to different machines than known units.

From one aspect, the invention consists in a paper-winding unit in which the paper is wound on a driven shaft mounted in a bearing at one end only.

From another aspect the invention consists in a paper-winding unit comprising an electric motor fixed to a mounting plate and driving a shaft carrying means for receiving the paper, a paper guide rod fixed to the mounting plate and extending parallel to said shaft, and switch means for controlling said motor provided with a longitudinally extending operating member, parallel to said guide rod, the ends of said shaft, said guide rod and said operating member remote from said mounting plate all being free, i.e., not separately supported.

It is to be understood that the paper to be wound on a paper-winding unit in accordance with the invention passes round said guide rod to the paper-receiving means on the shaft. The switch-operating member is located in the path of the paper between the guide rod and the paper-receiving means and the arrangement is such that, when the paper is taut, the operating member is moved from its normal position and actuates the switch means to disconnect the electrical supply from the motor. When the paper is slack, on the other hand, the operating member is held by spring means in its normal position in which electric power is supplied to the motor through the switch means.

Preferably, the paper-receiving means are arranged so that the paper can be wound on to a cardboard tube of the kind used as the core of a roll of new teleprinter paper. For this purpose, the shaft is provided with a fixed collar, having a number of external ribs designed to grip the interior of such a tube and also with a removable collar designed to fit on to the free end of the shaft and similarly provided with ribs to grip the interior of the cardboard tube. It is to be understood that the use of a removable collar not only facilitates the fitting and removal of the cardboard tubes, but also makes it possible to fit tubes of varying lengths.

Figure 1:
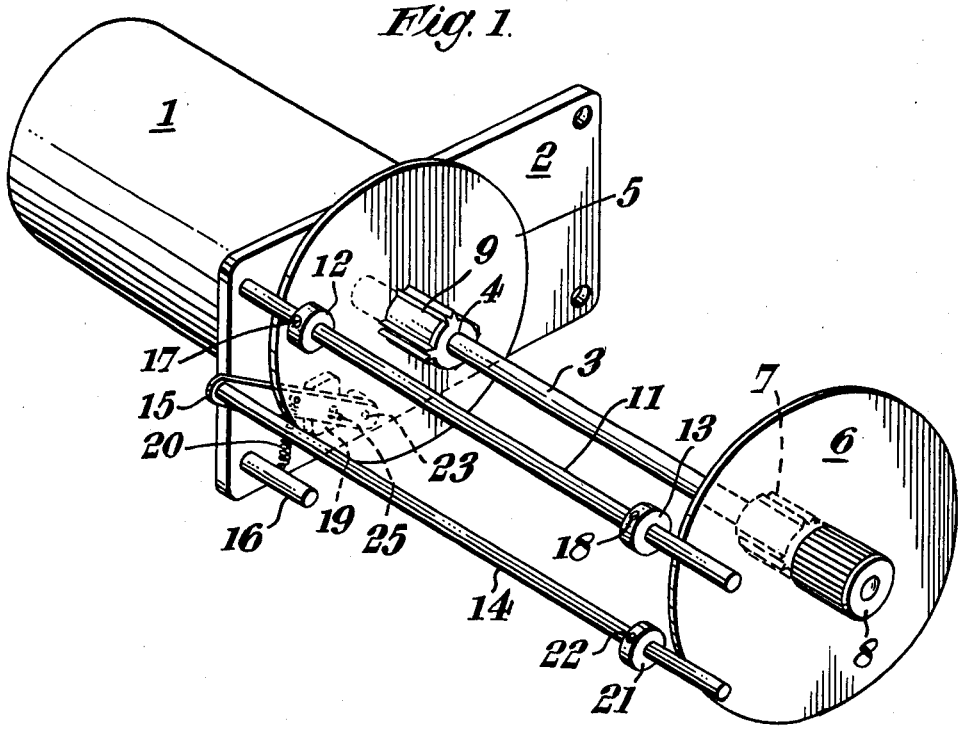
Figure 2:
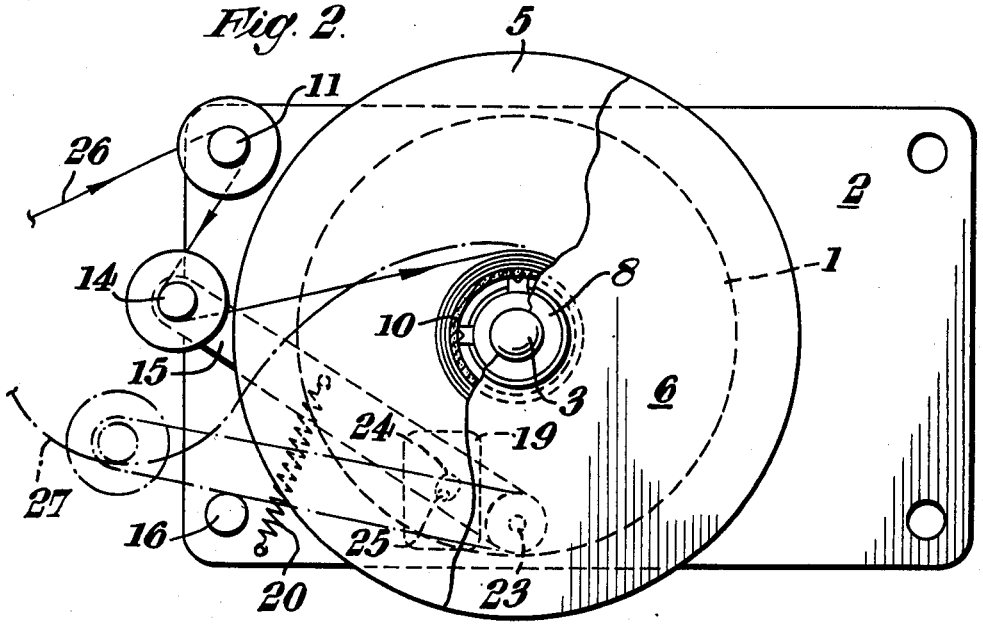

One method of performing the invention will now be described with reference to the accompanying diagrammatic drawings in which:

FIG. 1 is a perspective view of a paper-winding unit in accordance with the invention, and FIG. 2 is an end view of the unit illustrated in FIG. 1.

From these drawings it will be seen that one embodiment of the invention comprises an electric motor 1 mounted on a plate 2, which is capable of being secured to the frame of a teleprinter. The electric motor drives a shaft 3 carrying a fixed collar 4 and a fixed end plate 5. Slidable on the shaft 3 is a further end plate 6 and a collar 7. The movable end plate and collar are also provided with a milled knob 8 to assist in positioning these elements on the shaft. It is to be understood that, when the apparatus is in use, a cardboard tube 10 from a previously used roll of teleprinter paper is slid on to the collar 4 where it is gripped by the four ribs 9 and the unit consisting of the elements 6,7 and 8 is then pushed on to the free end of the shaft 3 with the collar 7 inside the cardboard roll, and with the ribs of this collar again holding the roll firmly in position.

Fixed to the mounting plate 2 is a guide rod 11, provided with collars 12 and 13 which are capable of being moved into the required positions in accordance with the width of the paper to be used. The collars 12 and 13 can be secured in the required positions on the guide rod 11 by means of set screws 17 and 18. The unit illustrated also includes a switch-operating member 14 mounted on a lever 15, which controls a switch 19. A collar 21 is provided on the operating member 14, and this collar may be fixed in the required position on the operating member by means of a set screw 22. The lever 15 is pivotally-mounted at 23, and is urged by a spring 20 in an anti-clockwise direction as seen in the drawings. A slot 24 is provided in the lever 15 to receive the actuating member 25 of the switch 19. The contacts of the switch 19 are arranged to close when the operating member is moved downwardly, as seen in the drawings, by anti-clockwise rotation of the lever 15, and to open when the actuating member 25 is moved upwardly as a result of clockwise rotation of the lever 15. The contacts of the switch 15 are connected in series with the electric power supply to motor 1, so that the motor rotates when the lever 15 is moved anti-clockwise and ceases to rotate when the lever 15 is rotated clockwise. A stop 16 is provided to limit movement of the operating member under the influence of the spring 20 when the paper is slack.

FIG. 2 of the drawings shows the lever 15 both in the clockwise and in the anti-clockwise position. The path of the paper is shown at 26 when the teleprinter is not operating so that no paper is being fed out from the teleprinter. It will be seen that, under these circumstances, the lever 15 is rotated to its clockwise position against the action of the spring 20, with the result that the actuating member 25 of the switch 19 is moved to its upper position and switches off the supply to the motor 1. When the teleprinter commences to operate, paper will be fed out and, as a result, will follow a path somewhat as shown at 27. Under these conditions, it will be seen that the spring 20 pulls the lever 15 into its anti-clockwise position against the stop 16. As a result, the actuating member 25 of the switch 19 is moved to its lower position, with the result that the motor 1 is turned on and the paper is wound on to the tube 10, thereby tightening the paper and eventually, when the teleprinter ceases to operate, switching off the motor 1 with the paper following the path 26.

It is to be understood that, if the teleprinter is used with an acoustic cover, the plate 2 may be mounted directly or indirectly on the cover instead of on the frame of the teleprinter.

What is claimed is:

1. A paper-winding unit in, or for use in connection with, a teleprinter, comprising a mounting plate;

an electric motor fixed to said mounting plate;

a shaft driven by said electric motor;

paper-receiving means carried by said shaft and having an end adjacent said mounting plate and a free end;

a paper guide rod fixed to said mounting plate and extending parallel to said shaft;

switch means for controlling said motor; and a longitudinally extending operating member for controlling said switch means, said operating member having one end near said mounting plate and extending parallel to said guide rod;

and wherein the ends of said shaft, said guide rod and said operating member remote from said mounting plate are not separately supported.

2. A paper-winding unit according to claim 1, further including a lever carrying said operating member;

stop means for said lever; and spring means urging said lever towards said stop means, said lever being located relative to said switch such that, when said lever is held against said stop means by said spring means, said switch means is closed to supply electric power to said motor, and when the paper is taut, said lever is urged away from said stop means counter to said spring to operate said switch means to open the circuit supplying electric power to said motor.

3. A paper-winding unit as claimed in claim 1, wherein the paper-receiving means include a cardboard tube, a first collar fixed to said shaft and having a plurality of external ribs adapted to grip the interior of said cardboard tube, and a second collar removably fitted on the free end of said shaft and similarly provided with ribs to grip the interior of the cardboard tube.

4. A paper-winding unit as claimed in claim 3 further including a first end plate fixed on said shaft between said first collar and said mounting plate, and a second end plate fixed to said second collar.

5. A paper-winding unit as claimed in claim 4, further including a milled knob fixed to said second end plate on the opposite end plate from said second collar.

6. A paper-winding unit as claimed in claim 1, further including two collars slidably arranged on said guide rod so that they can be positioned on said guide rod in accordance with the width of the paper being used.

* * * * *